US009802110B1

(12) United States Patent
Miller

(10) Patent No.: US 9,802,110 B1
(45) Date of Patent: Oct. 31, 2017

(54) SKATEBOARD TRUCK INCLUDING A STORAGE SPACE

(71) Applicant: David Miller, Port Richey, FL (US)

(72) Inventor: David Miller, Port Richey, FL (US)

( * ) Notice: Subject to any disclaimer, the term of this patent is extended or adjusted under 35 U.S.C. 154(b) by 0 days.

(21) Appl. No.: 14/600,969

(22) Filed: Jan. 20, 2015

Related U.S. Application Data

(63) Continuation-in-part of application No. 13/853,484, filed on Mar. 29, 2013, now abandoned.

(60) Provisional application No. 61/617,121, filed on Mar. 29, 2012.

(51) Int. Cl.
*A63C 1/28* (2006.01)
*A63C 17/26* (2006.01)
*A63C 17/01* (2006.01)

(52) U.S. Cl.
CPC ..... *A63C 17/26* (2013.01); *A63C 17/012* (2013.01)

(58) Field of Classification Search
CPC ..... A63C 1/02; A63C 3/00; A63C 17/0006; A63C 17/012; A63C 17/26; A63C 17/262; A63C 17/01; A63C 2203/00; A63C 2203/12; A63C 2203/14
USPC ... 280/87.043, 87.05, 87.021, 87.041, 87.01, 280/87.03, 87.042, 63
See application file for complete search history.

(56) References Cited

U.S. PATENT DOCUMENTS 2,854,132 A * 9/1958 Bjerknes ..... A45C 11/32 206/37
3,306,623 A 2/1967 Weitzner
3,677,569 A * 7/1972 Larson ..... B62B 3/02 108/44
4,997,196 A * 3/1991 Wood ..... A63C 17/01 280/87.042
5,065,878 A * 11/1991 Altmann ..... H02B 1/46 220/3.8
5,119,277 A * 6/1992 Copley ..... A63C 17/26 280/87.042
5,279,413 A * 1/1994 Nehl ..... A45C 1/02 206/0.82
5,857,682 A 1/1999 Hyman
5,921,653 A * 7/1999 Chien ..... A43B 1/0036 280/811
6,289,612 B1 9/2001 Kent
6,450,659 B1 * 9/2002 Salatino ..... A63C 17/06 280/11.19

(Continued)

*Primary Examiner* — J. Allen Shriver, II
*Assistant Examiner* — Travis Coolman
(74) *Attorney, Agent, or Firm* — H. John Rizvi; Gold & Rizvi, P.A.

(57) ABSTRACT

A skateboard truck mountable to a deck of a skateboard, the truck comprising a base plate including a storage cavity formed within the base plate for removably accommodating a storage drawer for storing small items. The storage cavity is arranged facing away from the skateboard deck when the truck is mounted onto the deck. The base plate can include a biasing member disposed at a distal end for propelling the storage drawer outwards from the storage cavity. The storage drawer can include a latch adapted to releasably engage with a drawer retention feature provided within the storage cavity, thus preventing the storage drawer from sliding out of the storage cavity. A release pin is provided within the base plate for releasably engaging the latch to dislodge the latch from the retention feature allowing the storage drawer to slide out from the storage cavity to gain access to the items.

19 Claims, 14 Drawing Sheets

(56) References Cited

Figure 1:
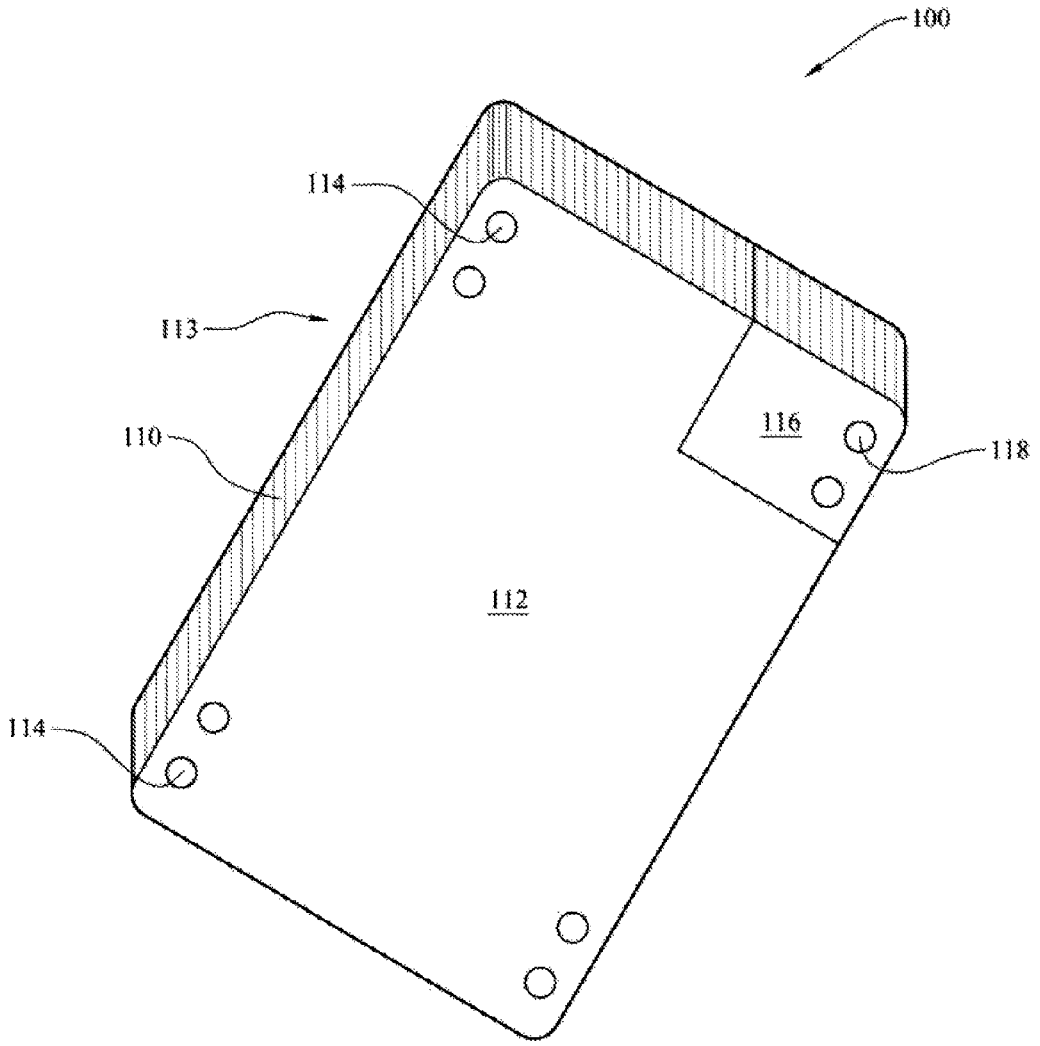

U.S. PATENT DOCUMENTS 6,646,547 B2 * 11/2003 Chiu ..... G08B 5/004 280/87.042
6,802,636 B1 * 10/2004 Bailey, Jr. ..... A63C 17/01 280/841
6,895,696 B1 5/2005 Sanders
7,048,284 B1 * 5/2006 Seifert ..... A63C 17/01 280/166
D530,384 S * 10/2006 Harrington ..... D21/765
7,635,137 B2 * 12/2009 Gregory ..... A63C 17/0086 280/87.041
D630,282 S * 1/2011 Ebanks ..... D21/771
7,866,673 B2 * 1/2011 Weber ..... A63C 1/30 219/201
8,317,206 B1 * 11/2012 Novitzky ..... A63C 17/008 280/87.042
8,628,099 B2 * 1/2014 Gregory ..... A63C 17/0086 280/87.041
8,827,286 B2 * 9/2014 Woncik ..... A63C 17/0006 280/87.042
D724,683 S * 3/2015 Sandiford ..... D21/771
2003/0185019 A1 * 10/2003 Rogers ..... A63C 17/0093 362/545
2003/0201620 A1 * 10/2003 Seelye ..... A63C 17/01 280/87.042
2004/0100055 A1 * 5/2004 Chang ..... A63C 17/01 280/87.042
2004/0251287 A1 12/2004 Myers
2005/0172520 A1 8/2005 Simmons-Gettig
2005/0227555 A1 10/2005 Barnes
2006/0249513 A1 11/2006 Duke
2008/0036165 A1 * 2/2008 Reinson ..... A63C 17/01 280/87.042
2008/0110060 A1 5/2008 Ritter
2009/0236811 A1 * 9/2009 Lewis ..... A63C 17/0093 280/87.042
2011/0203139 A1 8/2011 Eidson et al.
2014/0265200 A1 * 9/2014 Signorelli ..... A63C 17/0006 280/87.042
2016/0129337 A1 * 5/2016 Weber ..... A63C 17/262 280/727
2016/0175693 A1 * 6/2016 Page ..... A63C 17/26 280/87.042
2016/0195246 A1 * 7/2016 Carattini ..... F21S 48/30 362/486

* cited by examiner

SKATEBOARD TRUCK INCLUDING A STORAGE SPACE

CROSS-REFERENCE TO RELATED APPLICATIONS

This application claims the benefit of U.S. patent application Ser. No. 13/853,484 filed on Mar. 29, 2013, which in turn claims the benefit of U.S. Provisional Patent Application Ser. No. 61/617,121 filed on Mar. 29, 2012, all of which are incorporated herein in their entirety.

FIELD OF THE INVENTION

The present invention relates generally to skateboards and skateboard accessories. More particularly, the present disclosure relates to a skateboard truck that is mountable to the bottom deck of a skateboard and includes a storage cavity for discretely storing a variety of small items therein.

BACKGROUND OF THE INVENTION

Conventional skateboards typically include an elongated deck for a person to stand on, a pair skateboard trucks attached to a bottom surface of the deck, and a set of wheels rotatably carried by each skateboard truck to provide mobility. The elongated deck is generally constructed from a wood, plastic, or fiberglass material, comes in a variety of different shapes and sizes, and includes a broad range of patterns, designs and colors to enhance the aesthetic appearance of the skateboard. Each skateboard truck typically includes an axle ("hanger") affixed to a base plate with a nut and bolt ("kingpin"), and a bushing that permits the axle to rotate freely about a vertical axis when riding the skateboard. The set of wheels are mounted at opposite ends of the truck axle, via, bearings, and are typically fabricated from a hard, durable rubber designed to withstand wear and tear and impact forces when negotiating the skateboard on hard surfaces.

Optionally, riser pads or risers may be placed between the skateboard truck and the bottom surface of the skateboard deck in order to further separate the skateboard deck from the axle. In assembly, riser pads are securely attached to the bottom surface of the deck via, screws or a bonding agent, and a truck is firmly mounted to each riser pad. Riser pads come in a variety of different shapes and sizes and are generally fabricated from a metal or plastic material. Riser pads are employed to prevent what is often referred to as "wheel-bite". Wheel bite often occurs when the wheels of the skateboard come in contact with the elongated deck forcing the wheels to stop abruptly and lockup. Wheel bite results from multiple landings after doing tricks, traveling too fast causing wheel wobble. Wheel bite can also result from loosened trucks. In certain circumstances, an abrupt stop of the rotating wheels can cause a user to lose control of the skateboard, and project the user off the deck. The propelling force can cause the person to sustain injury, especially if moving along at high speeds. Riser pads provide the additional benefit of reducing strain on the elongated deck. Strain is often imposed on the elongated deck as a result of constant impact forces generated on the trucks. Without riser pads, impact forces can cause damage to the elongated deck resulting in the deck cracking or splitting. Thus, riser pads are employed to avoid injury that may occur as a result of wheel bite, and prevent damage to the skateboard deck due to impact forces on the trucks.

In use, conventional skateboards are generally disposed on the ground, and propelled forward by placing one foot on the elongated deck of the skateboard, and using the other foot to push off the ground. Once in motion, the user simply stands on the deck of the skateboard with both feet placed apart from one another while maintaining balance with the torso and arms. Alternatively, the person may stand on the deck of the skateboard while on a downward slope allowing gravity to propel the skateboard. Directional movement of the skateboard is typically controlled by shifting and maneuvering the feet of the user while standing on the deck of the skateboard.

Skateboards are recreational devices that are often used for both riding and amusement. Many recreational centers and schools offer skateboarding programs that are designed, with safety in mind, to provide coordinated programs for individuals wanting to participate in skateboarding activities. There are different forms of skateboarding activities available to skateboarders. For example, one popular activity includes land paddling. Land paddling involves using a long pole to engage the ground surface and propel the rider forward. Use of skateboards has also been entertained by the military. For example, the United States Marine Corps has tested the usefulness of commercial off-the-shelf skateboards during urban combat military exercises in the late 1990s in a program called "Urban Warrior "99".

Another popular skateboarding activity includes street skateboarding. Street skateboarding is viewed by many as a form of independent and cultural expression, an art, personal freedom, and exercise. Young interest groups often desire diverse infrastructures that are conducive for performing tricks with skateboards. For example, users often negotiate skateboards on stairwells, handrails, curbs, slanted pavement or walls, ledges and even park benches. Since traffic congestion and populated areas severely limit the use of skateboarding during the daylight hours, street skateboarding has become a popular night sport where congestion of traffic and people are at a minimum. Though the night time hours invite many to engage in skateboard activities, it is also a time period in which crime is prevalent in many inner city neighborhoods. Criminal activity often results in street skateboarders being robbed of their cash, expensive jewelry, or other small valuables.

Conventional skateboards do not permit a user to conveniently and discretely store small personal items on the device itself. It is literally impossible to store a variety of small items on prior art skateboards because the skateboards have no storage area designated for that purpose. Street skateboarding involves jumping up and down with the skateboard, flips, negotiating curbs, maneuvering along handrails, and rolling along rugged asphalt. The continuous shuffling makes it difficult for storing items securely on the skateboard. Thus, small personal items must be stored within a shirt or pant pocket, a jacket, or a small bag. Storing valuable items on the person poses a risk. For example, urban robbers are aware that individuals are likely to carry cash, keys, jewelry, and other valuable items in their pockets, wallets, or even shoes. Street skateboarders often carry a variety of items such as small knives for protection, expensive jewelry including rings or chains, or money. It is risky for street skateboarders to store such items in pant or shirt pockets since these are places a robber will likely search. The ability to store items in an unobvious, discrete location on a skateboard alleviates the need of having to store such items on the person or in a portable bag.

In an effort to address the storage concerns, some prior art skateboards and other sport boards include a variety of different storage devices that are separately attached to the boar itself. For example, storage devices such as bags, pouches, or small receptacles are separately attached to the board using a bonding agent, or mechanical fasteners. Externally attaching storage devices to skateboards compromises the skateboard's balance, provides a bulky and heavier skateboard, and does not provide a discrete manner for storing items. For example, a robber, with little or no effort, can easily locate the storage device that is externally attached to the skateboard. Another drawback of the prior art is that the separately attached storage device can be damaged during use of the skateboard or interfere with the skater's ability to maneuver and/or complete various tricks. Other prior art skateboards have included a hollowed chamber that is formed within the deck of the skateboard itself. However, the hollowed chamber compromises the structural integrity of the skateboard.

These and other advantages of the invention will be further understood and appreciated by those skilled in the art by reference to the following written specification, claims and appended drawings.

SUMMARY OF THE INVENTION

The present invention overcomes the deficiencies of the known art and the problems that remain unsolved by providing a storage device for use with skateboards for discretely and securely storing a variety of small items therein without compromising the structural integrity and performance of the skateboard during use. What is further desired is a storage device that is easily accessible, includes sufficient space for holding a number of small items therein, and is part of an already existing component of the skateboard.

Introducing a first embodiment of the invention, the present invention consists of a skateboard truck comprising a base plate, an elevated portion extending from the base plate, and an axle attached to the elevated portion, wherein the base plate comprises:

- a cavity opening passing through a segment of an outer wall of the base plate;
- an inner cavity extending inward from the cavity opening and bound by a cavity defining surface;
- a plurality of mounting holes formed through the base plate, wherein each mounting hole is located proximate an outer edge of the base plate and at a periphery of the inner cavity, wherein a pattern of the mounting holes is arranged to align with mounting apertures of a skateboard deck;
- a storage drawer including a drawer bottom integrally joined to drawer sidewalls, a drawer end wall, and a drawer front wall defining an item storage compartment volume for retaining a variety of items therein, wherein the item storage compartment volume is oriented toward the axle, and wherein the storage drawer is removably insertable through the cavity opening and into the inner cavity, to conceal the item storage compartment volume.

In a second aspect, the storage device further includes a biasing member positioned within the inner cavity at a location generally opposing the cavity opening, to readily engage with the drawer end wall when the storage drawer is inserted within the inner cavity.

In another aspect, the biasing member comprises a spring that is compressed when the storage drawer in fully inserted within the inner cavity.

In another aspect, the storage device further includes:

- a release latch access aperture formed perpendicular through the base plate and extending within the inner cavity;
- a drawer latch retention feature integrated into a portion of the cavity defining surface at a location proximate the release latch access aperture;
- a resilient latch including one end integrally formed with one of the drawer sidewalls and a flexible end tapering outwards away from the one of the drawer sidewalls; and
- a release pin retained within the release latch access aperture, the release pin having a distal end engaging with the flexible end of the resilient latch;
- wherein the storage drawer is removably insertable through the cavity opening and inserted into the inner cavity such that a front edge of the flexible end of the resilient latch releasably engages the drawer latch retention feature, and wherein the release latch access aperture aligns with the flexible end of the resilient latch when the storage drawer is fully inserted within the inner cavity.

In another aspect, the release pin includes a crossbar extending perpendicularly outward from the release pin forming a first stub and a second stub situated opposite the first stub.

In another aspect, the release latch access aperture includes a first indentation receiving the first stub, and a second indentation receiving the second stub, each indentation having a predetermined length adapted to permit the release pin to slide back and forth within the release latch access aperture without falling out of the release latch access aperture.

In another aspect, the release pin is slidably movable inward, against an outward biasing force provided by the flexible end of the resilient latch, to dislodge the front edge of the flexible end of the resilient latch from the drawer latch retention feature freeing the storage drawer.

In another aspect, the storage device further comprises a biasing member positioned within the inner cavity at a location generally opposing the cavity opening, to readily engage with the drawer end wall when the storage drawer is inserted within the inner cavity, wherein the biasing member to propels the storage drawer outwards from the inner cavity when the storage drawer is freed, to expose items stored in the storage drawer.

Introducing another embodiment of the invention, the present invention consists of a skateboard truck, comprising a base plate, an elevated portion extending from the base plate, and an axle attached to the elevated portion, wherein the base plate is defined by a top member and a bottom member attached to one another, wherein the base plate comprises:

- a cavity opening passing through a segment of an outer wall of the base plate;
- an inner cavity extending inward from the cavity opening and bound by a cavity defining surface;
- a plurality of mounting holes formed through the base plate, wherein each mounting hole is located proximate an outer edge of the base plate, wherein a pattern of the mounting holes is arranged to align with mounting apertures of a skateboard deck;
- a release latch access aperture formed perpendicular through the base plate and extending within the inner cavity;

a drawer latch retention feature integrated into a portion of the cavity defining surface at a location proximate the release latch access aperture;

a storage drawer including a drawer bottom integrally joined to drawer sidewalls, a drawer end wall, and a drawer front wall defining an item storage compartment volume for retaining a variety of items therein, wherein the item storage compartment volume is oriented toward the axle;

a resilient latch including one end integrally formed with one of the drawer sidewalls and a flexible end tapering outwards away from the one of the drawer sidewalls; and wherein the storage drawer is removably insertable through the cavity opening and inserted into the inner cavity such that a front edge of the flexible end of the resilient latch releasably engages the drawer latch retention feature, and wherein the release latch access aperture aligns with the flexible end of the resilient latch when the storage drawer is fully inserted within the inner cavity.

Introducing yet another embodiment of the invention, the present invention consists of a skateboard truck comprising a base plate configured to be attached to a skateboard deck, wherein the base plate includes:

a deck-facing surface configured to be arranged towards a skateboard deck, a cavity opening passing through an outer sidewall of the base plate;

an inner cavity extending inward from the cavity opening and bound by a cavity defining surface;

a release latch access aperture formed perpendicular through the base plate and extending within the inner cavity;

a drawer latch retention feature integrated into a portion of the cavity defining surface at a location proximate the release latch access aperture;

a storage drawer including a drawer bottom integrally joined to drawer sidewalls, a drawer end wall, and a drawer front wall defining an item storage compartment volume for retaining a variety of items therein, wherein the item storage compartment volume is configured to be oriented away from the deck-facing surface;

a resilient latch including one end integrally formed with one of the drawer sidewalls and a flexible end tapering outwards away from the one of the drawer sidewalls; and wherein the storage drawer is removably insertable through the cavity opening and into the inner cavity such that a front edge of the flexible end of the resilient latch releasably engages the drawer latch retention feature, and wherein the release latch access aperture aligns with the flexible end of the resilient latch when the storage drawer is fully inserted within the inner cavity.

These and other aspects, features, and advantages of the present invention will become more readily apparent from the attached drawings and the detailed description of the preferred embodiments, which follow.

DETAILED DESCRIPTION OF THE DRAWINGS

Figure 2:
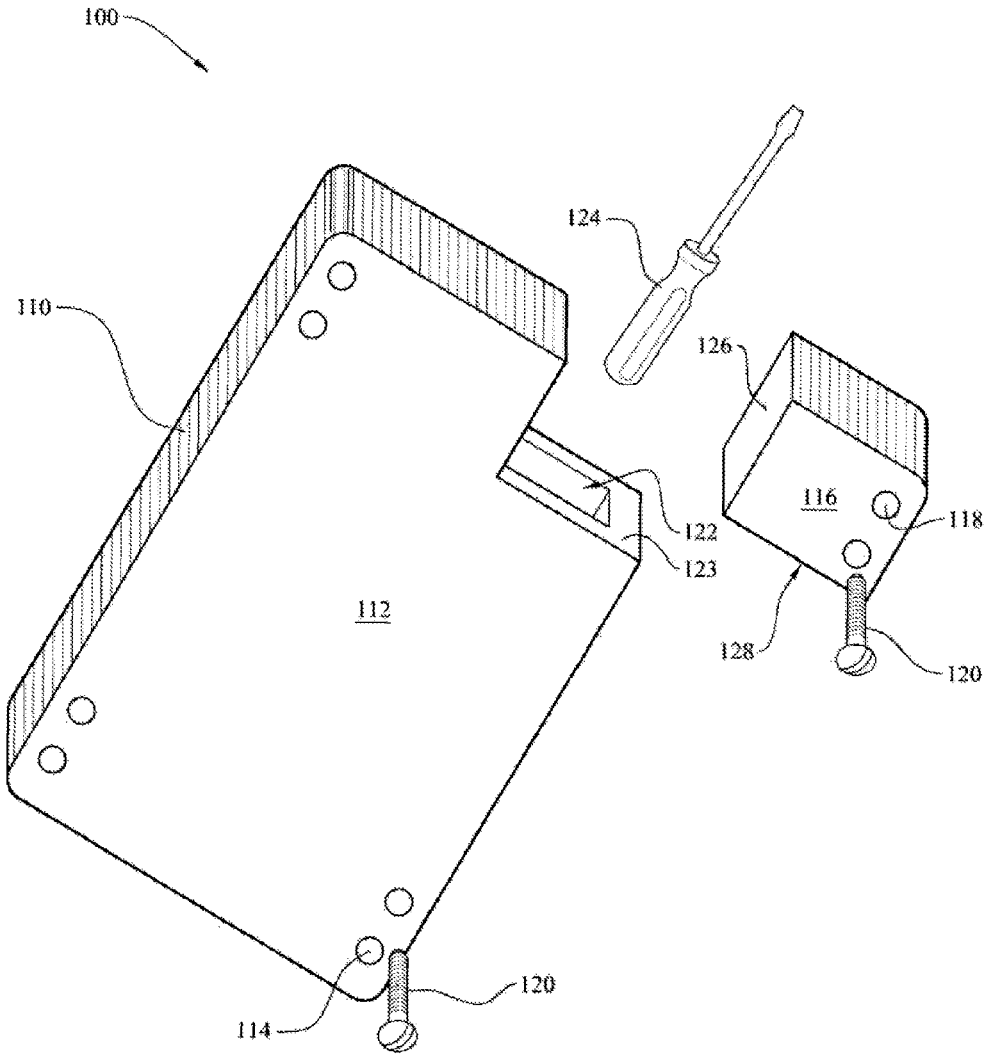
Figure 3:
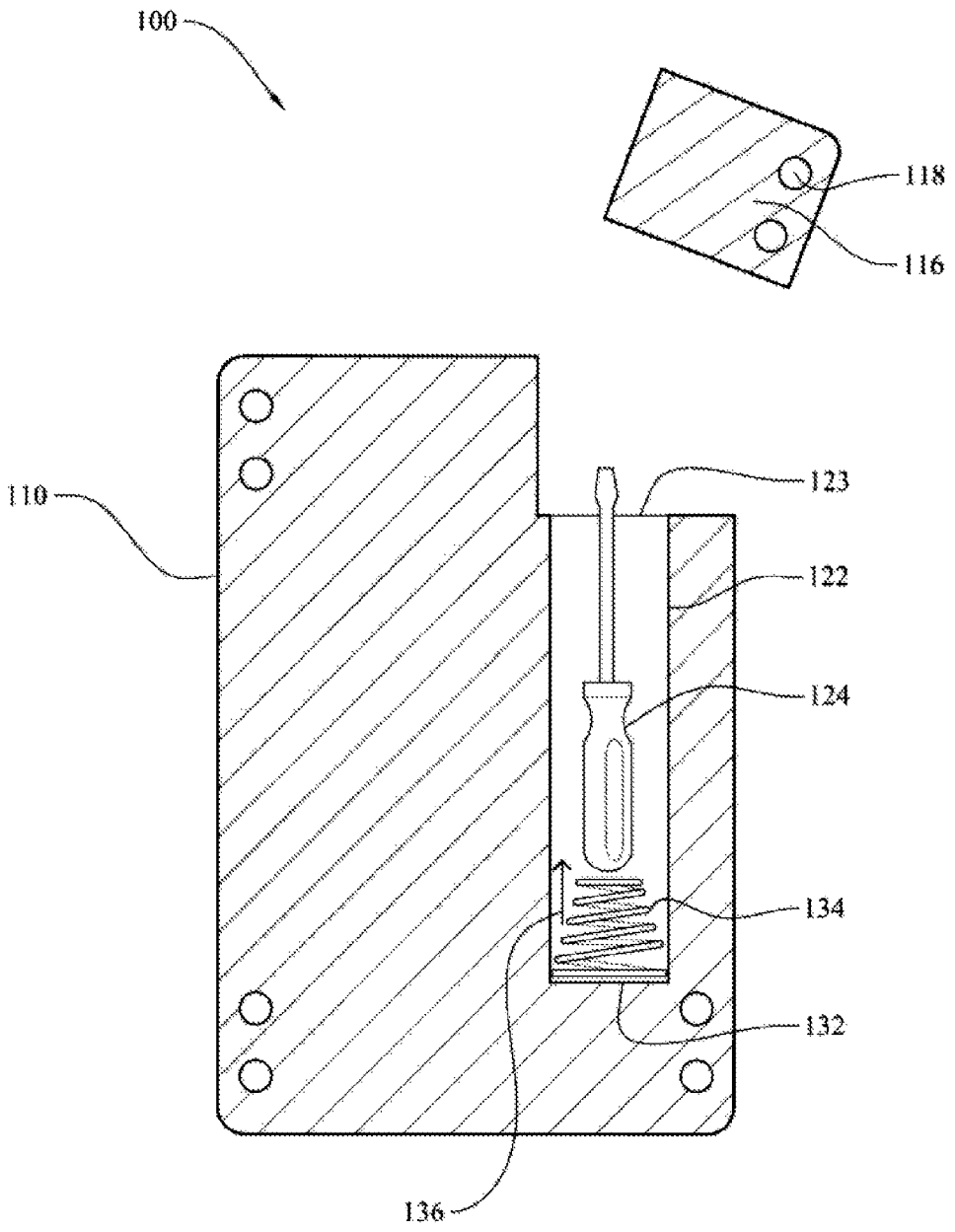
Figure 4:
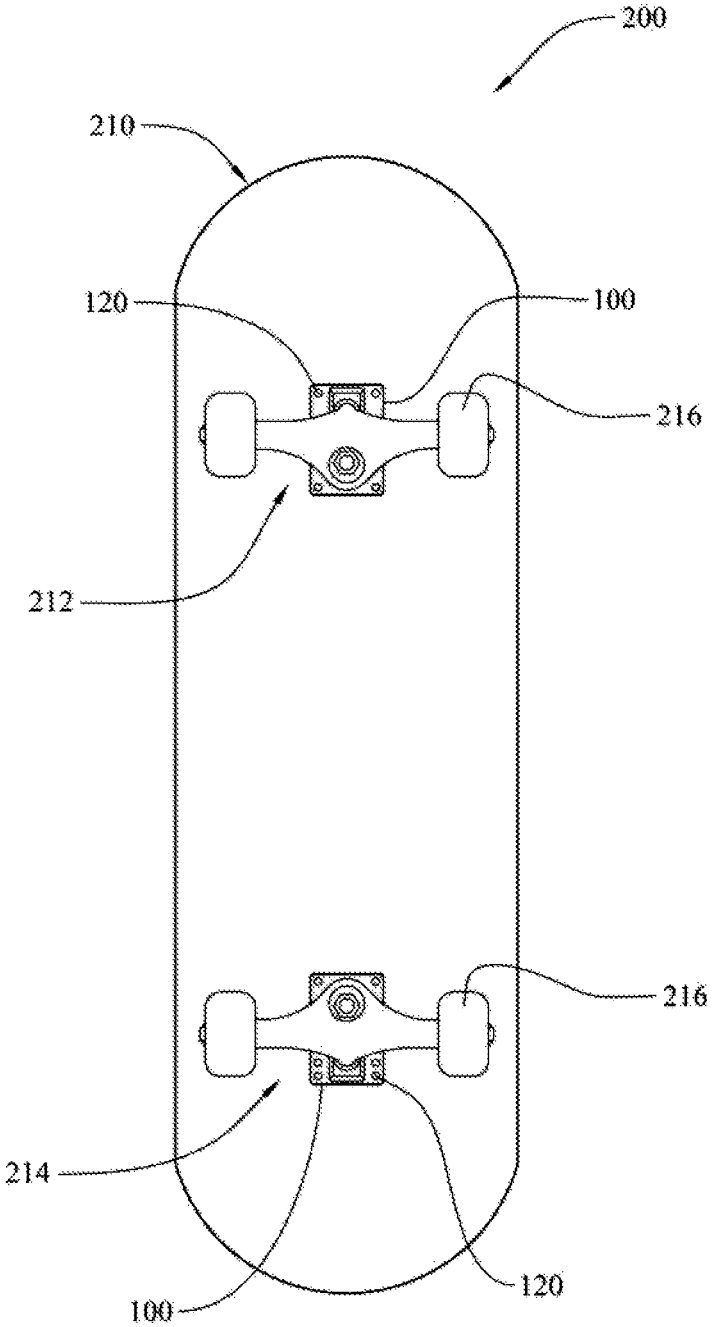
Figure 5:
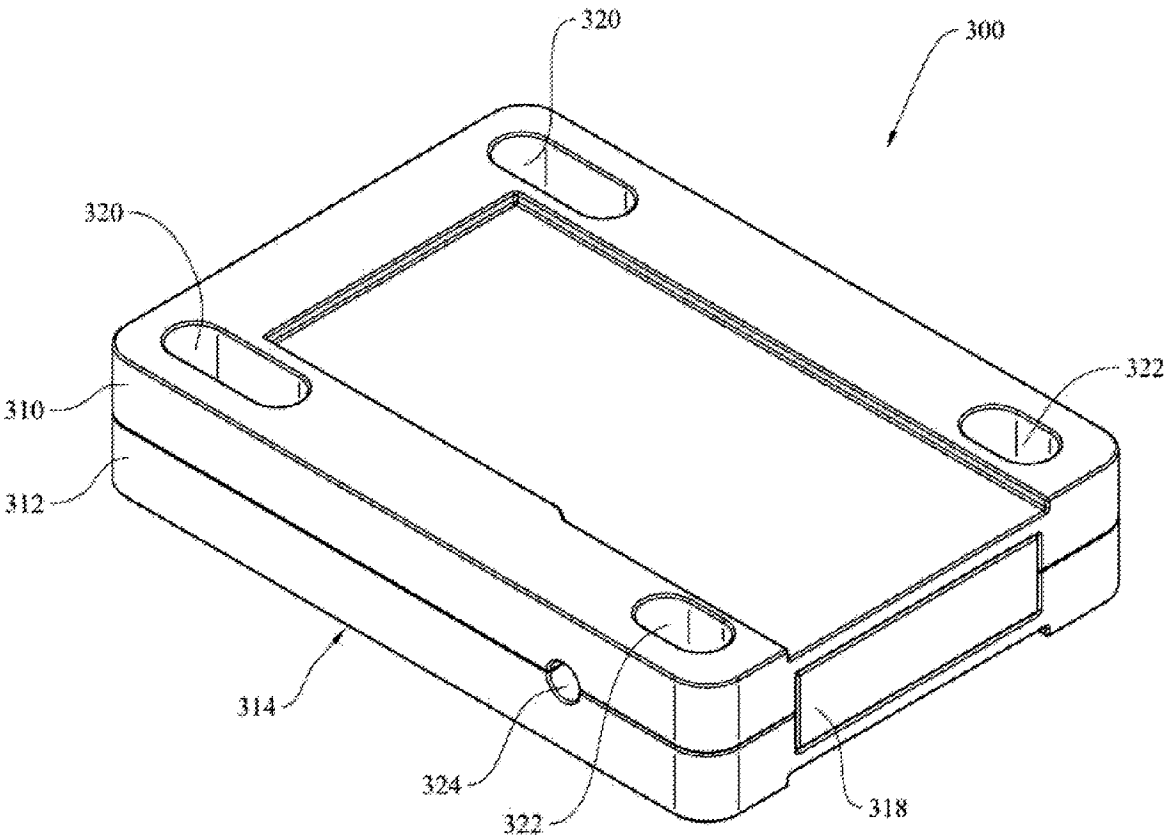
Figure 6:
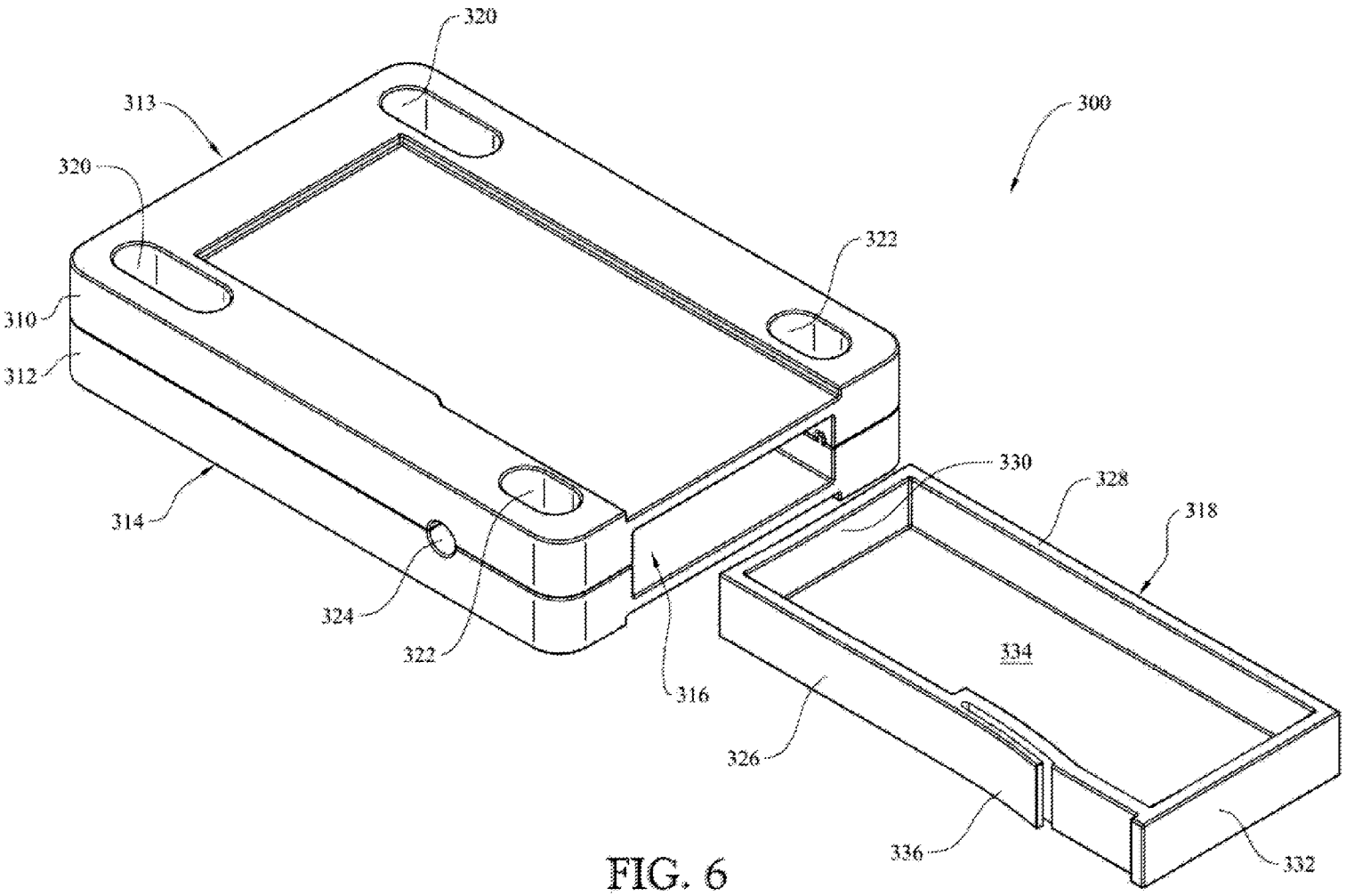
Figure 7:
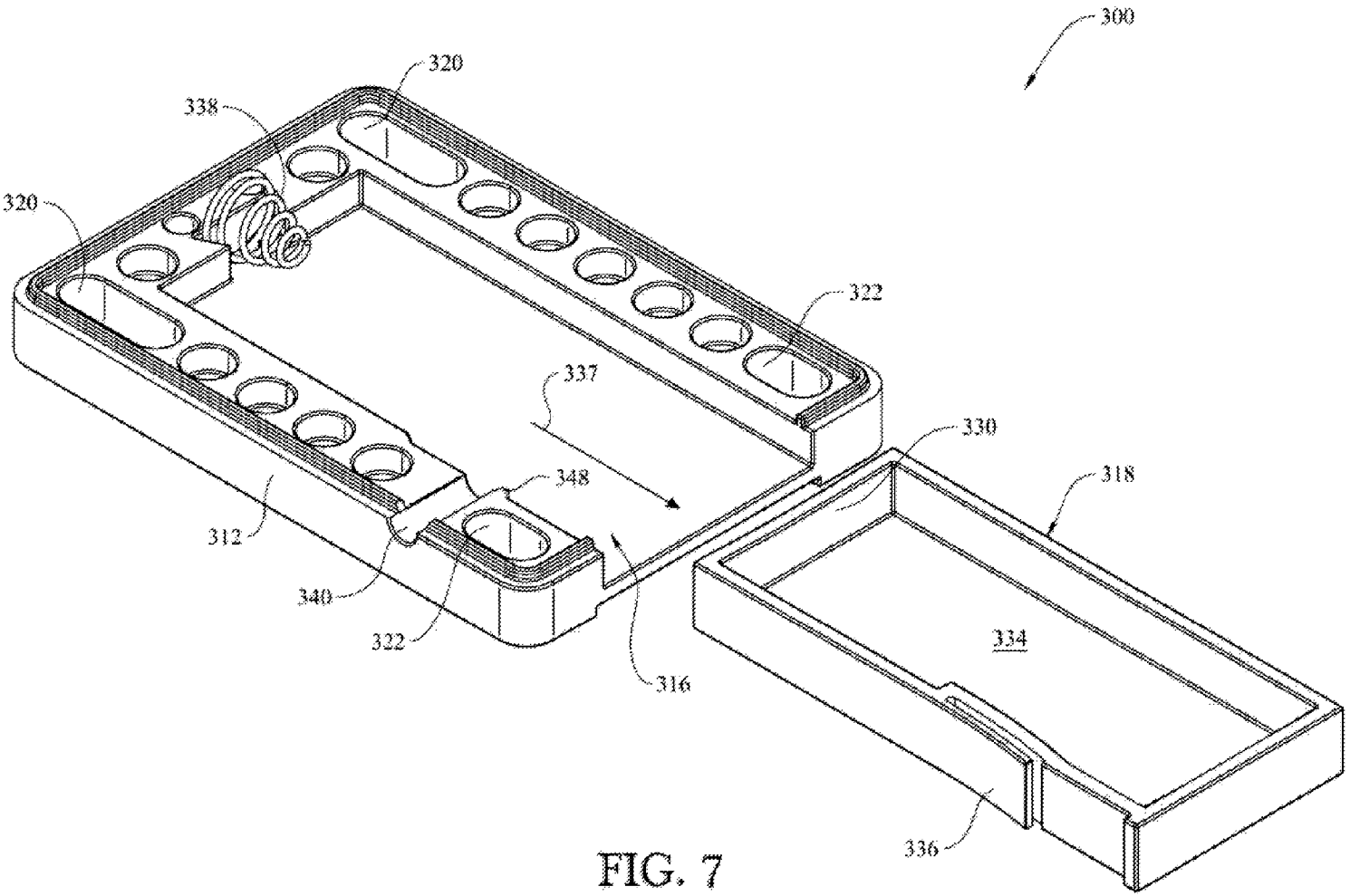
Figure 8:
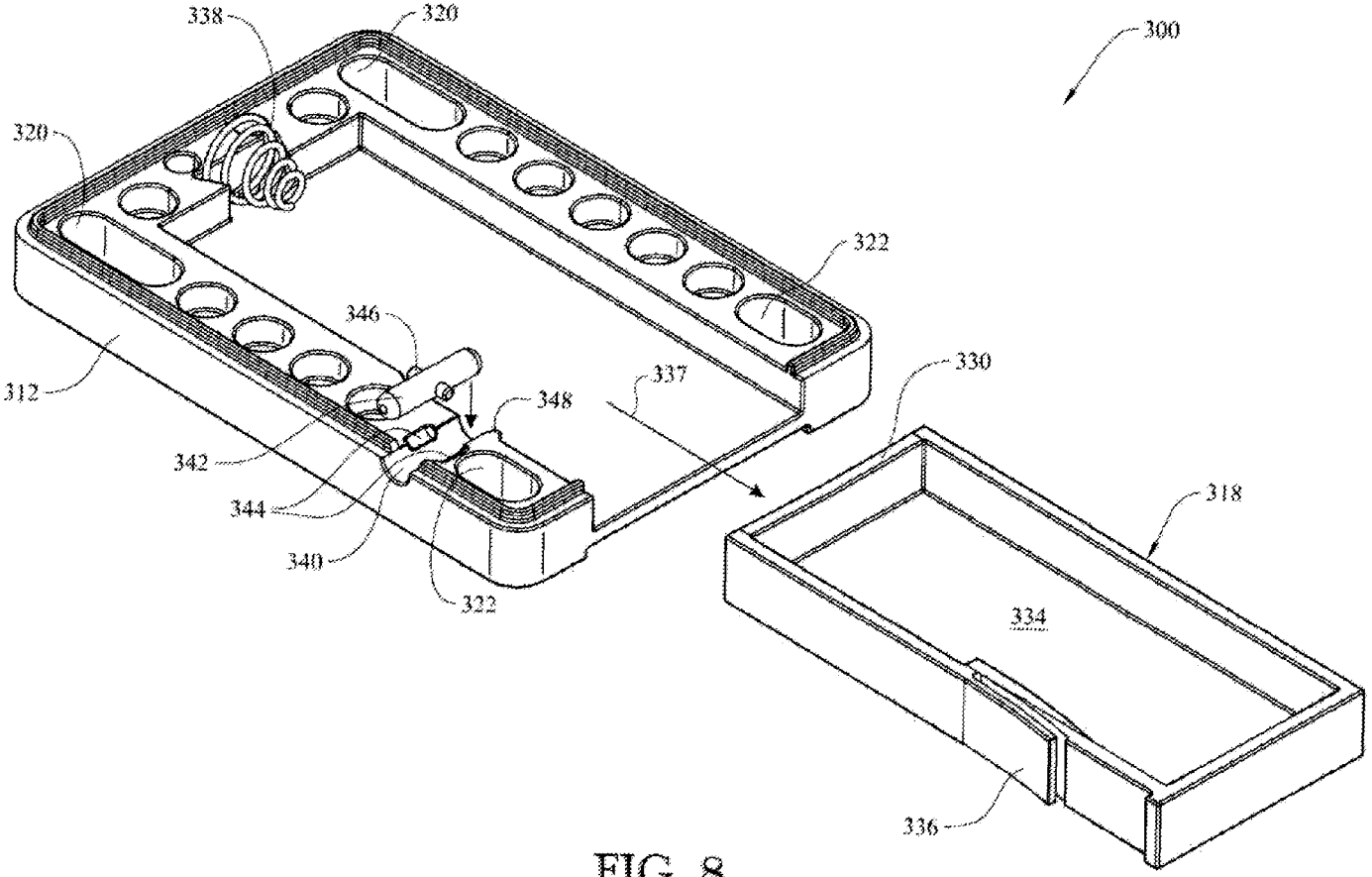
Figure 9:
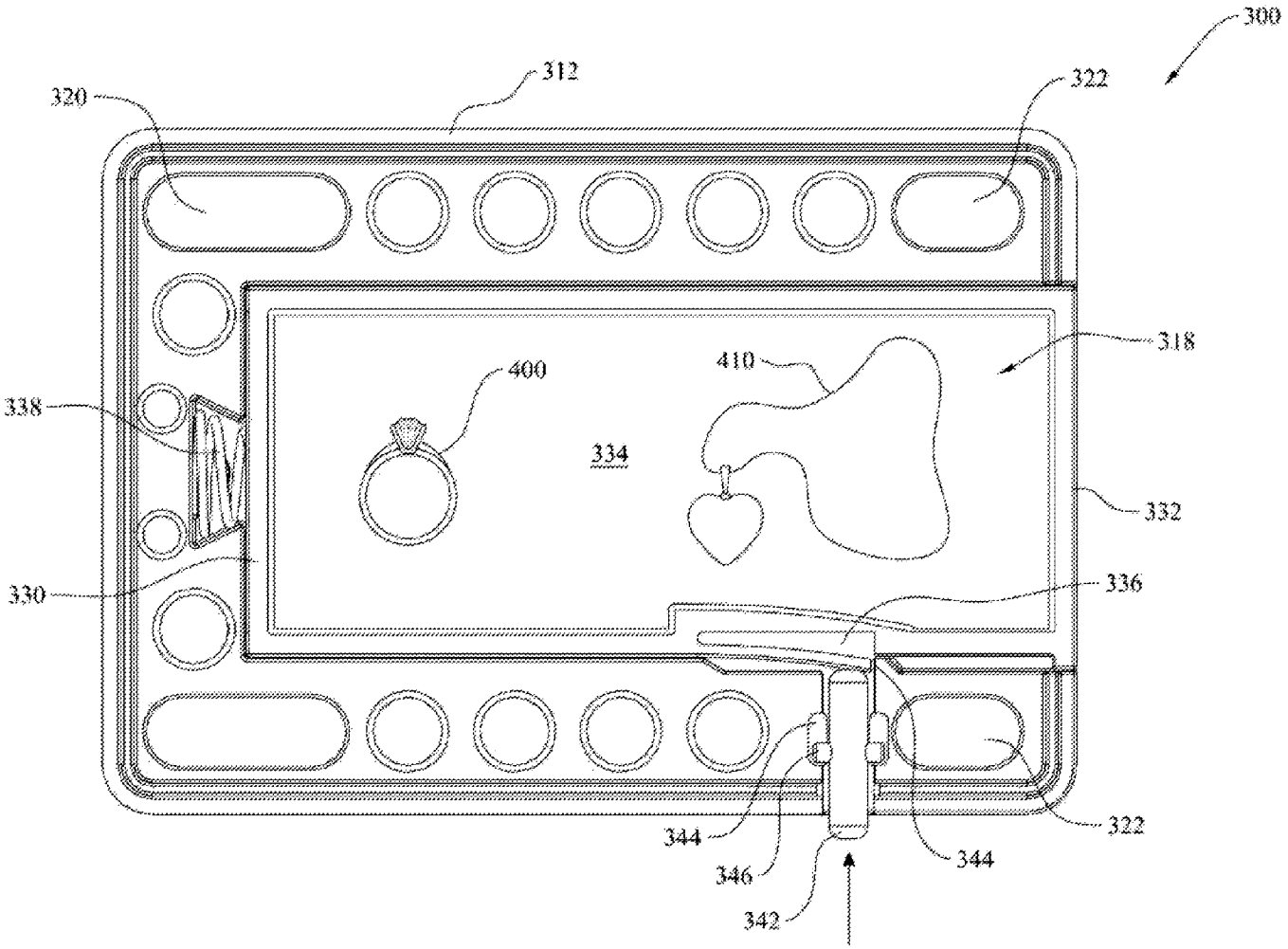
Figure 10:
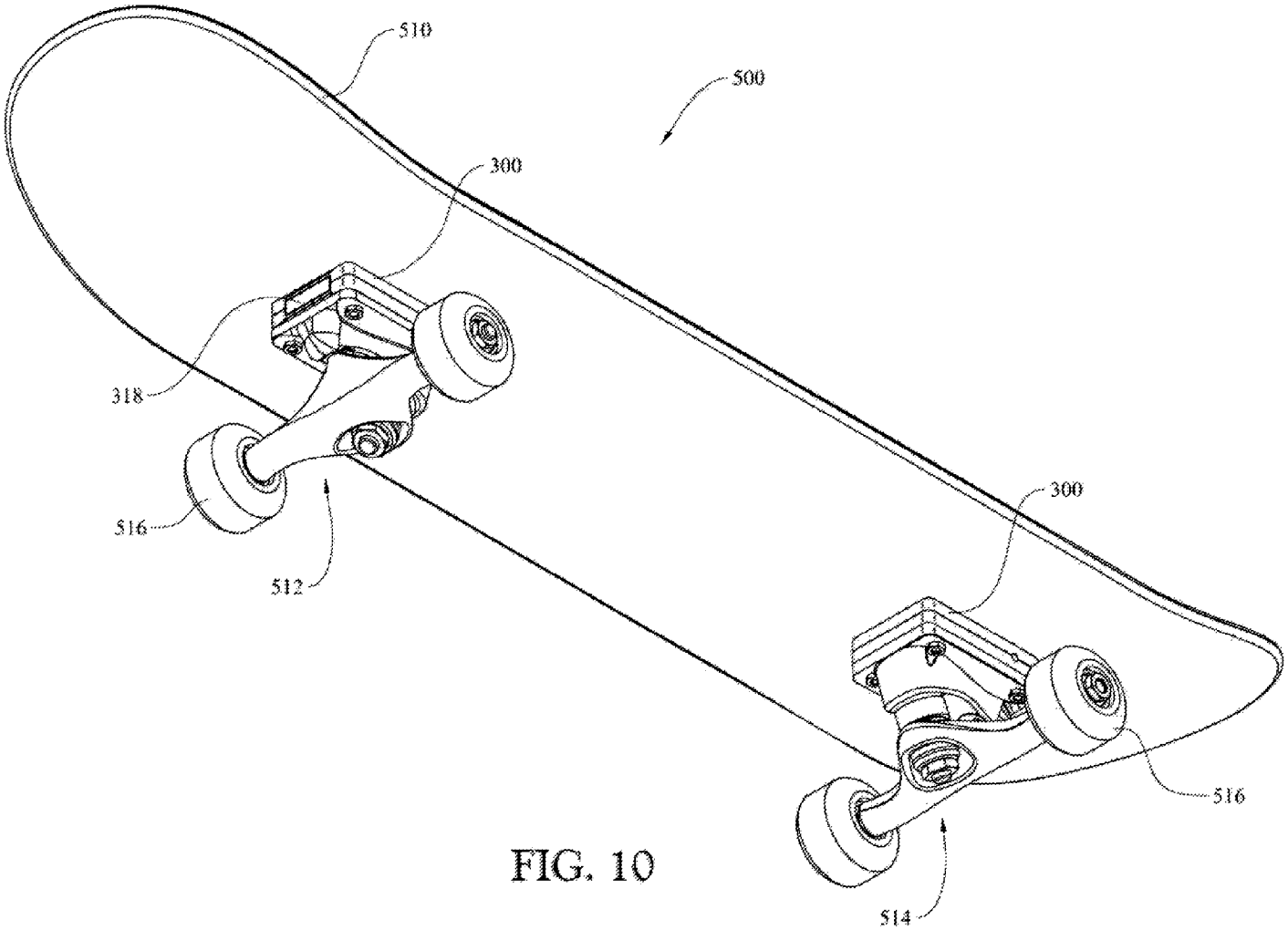
Figure 11:
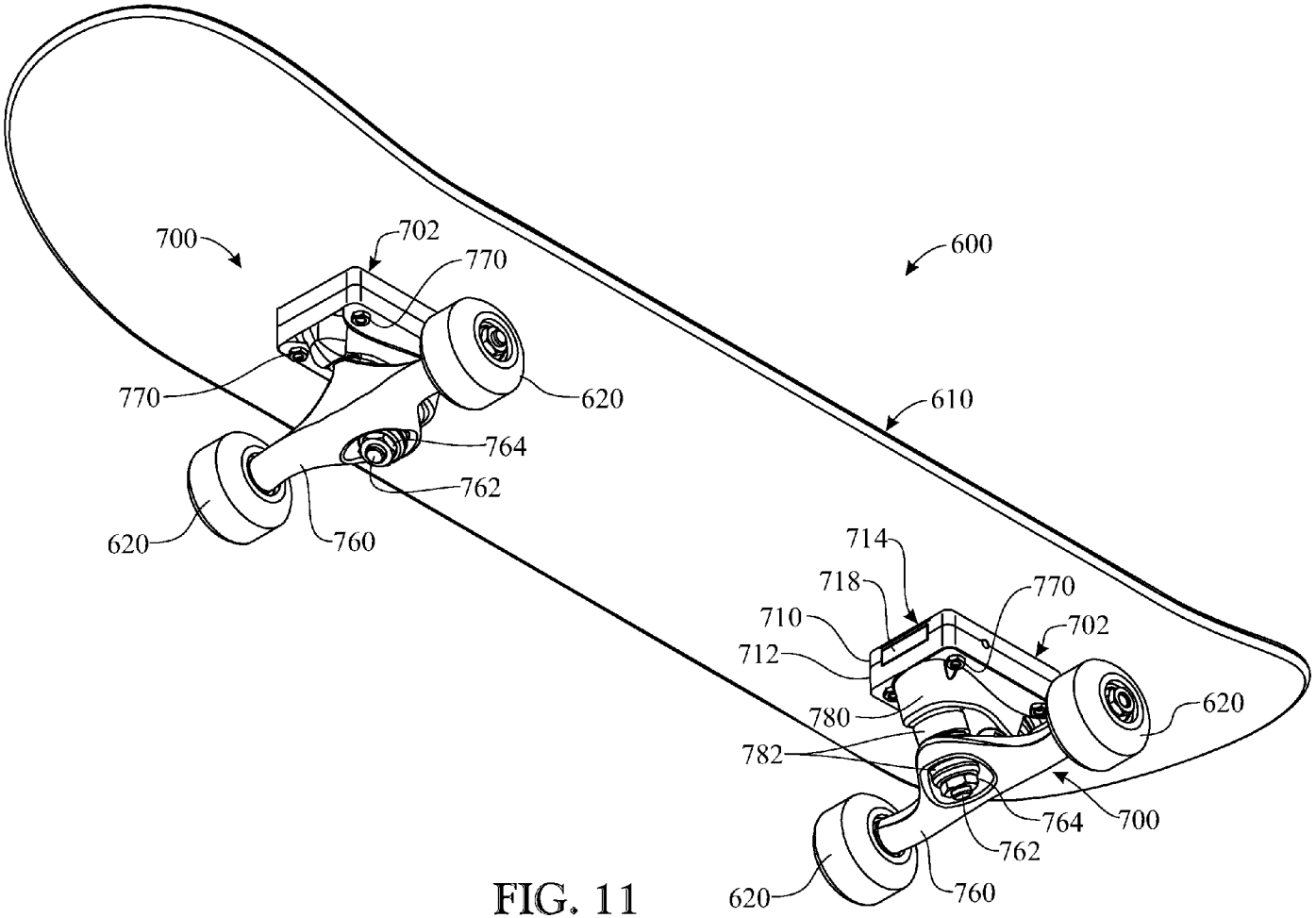
Figure 12:
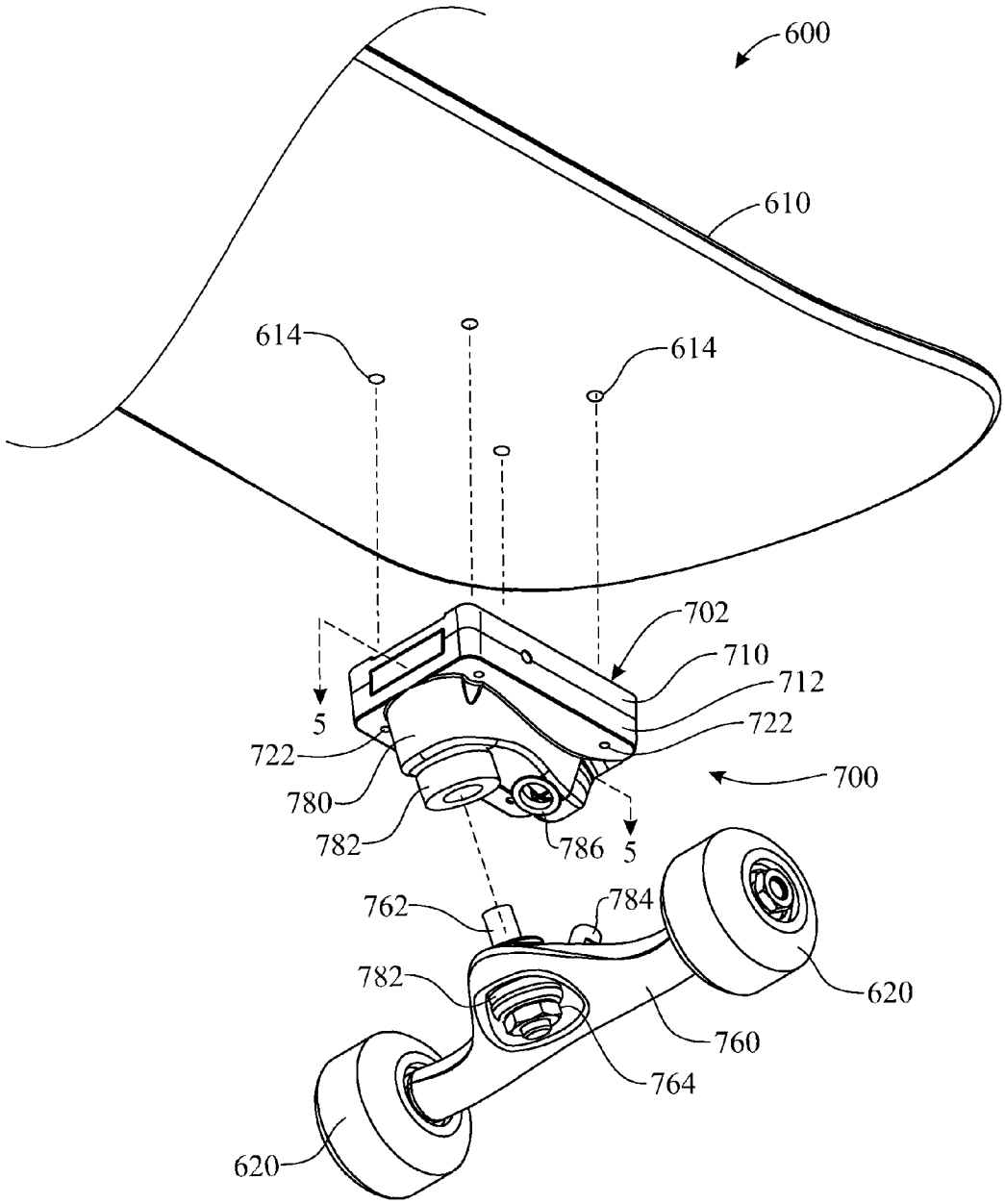
Figure 13:
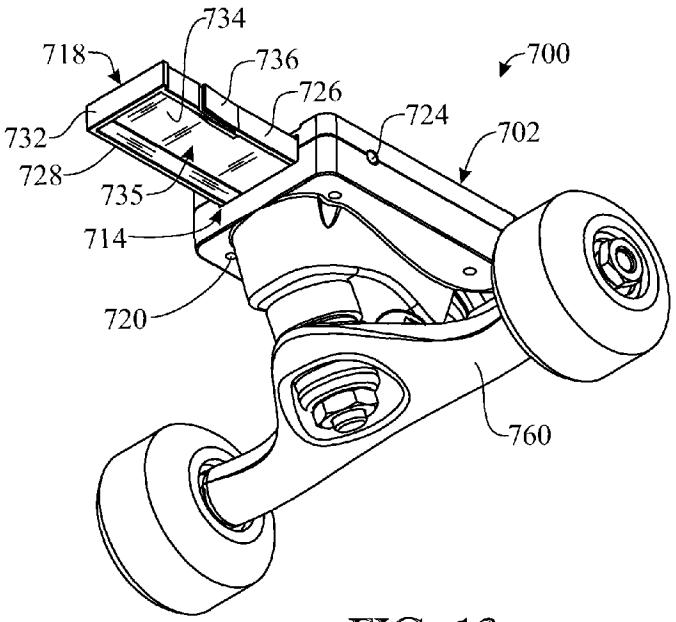
Figure 14:
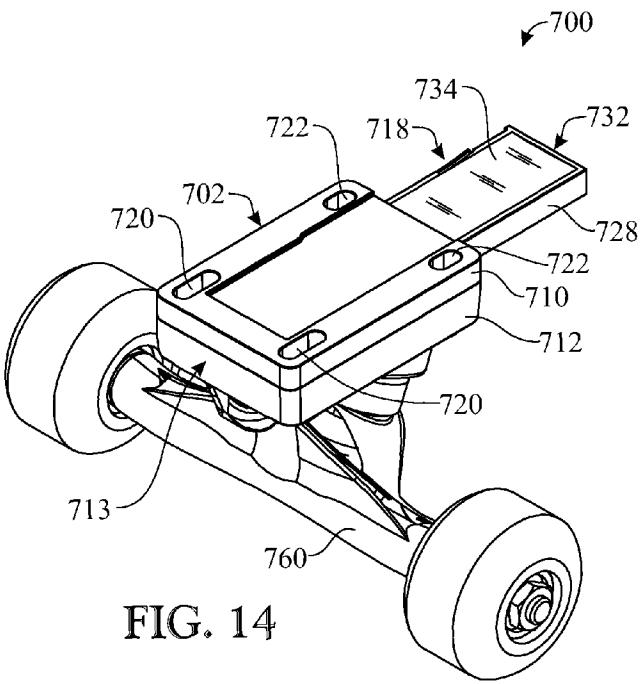

The preferred embodiments of the invention will hereafter be described in conjunction with the appended drawings provided to illustrate and not to limit the invention, in which:

FIG. 1 presents an isometric view of an storage device including a plurality of holes for mounting the storage device on the bottom surface of a skateboard, in accordance with one exemplary embodiment of the present invention;

FIG. 2 presents an isometric view of the storage device originally introduced in FIG. 1, showing a detachable closure removed to expose a storage cavity formed and sized for storing a variety of small items within a body of the storage device;

FIG. 3 presents a cross-sectional view of the storage device originally introduced in FIG. 1, showing the detachable closure, a biasing member disposed at the bottom end of the storage cavity, and an exemplary item stored within the storage cavity;

FIG. 4 presents a bottom view of an exemplary skateboard including a pair of storage devices, originally introduced in FIG. 1, wherein each storage device is installed between a bottom surface of the skateboard and a respective skateboard truck;

FIG. 5 presents an isometric view of a storage device including a plurality of holes for mounting the storage device to the bottom surface of a skateboard, in accordance with a second exemplary embodiment of the present invention;

FIG. 6 presents an isometric view of the storage device originally introduced in FIG. 5, showing a storage drawer removed from a storage cavity formed within a housing;

FIG. 7 presents an isometric view of the storage device originally introduced in FIG. 5, the illustration omitting a top member of the housing exposing a biasing member secured at a distal end of a bottom member, detailing a formation of a lower portion of a release latch access aperture formed within the bottom housing member, and detailing the storage cavity for removably receiving the storage drawer;

FIG. 8 presents an isometric view of a modified version the storage device originally introduced in FIG. 5, wherein the modified version introduces a release pin slidably assembled within the release latch access aperture for ready engagement with the resilient latch of the storage drawer;

FIG. 9 presents a top view of the modified storage device originally introduced in FIG. 8, showing the storage drawer fully inserted within the storage cavity, compressing the biasing member, the release pin readily engaged with the resilient latch of the storage drawer, and a variety of small items stored within the storage drawer; and FIG. 10 presents a bottom perspective view of the exemplary skateboard including a pair of second exemplary storage devices, originally introduced in FIG. 5, wherein each storage device is installed between the bottom surface of the skateboard and the respective skateboard truck;

FIG. 11 presents a bottom perspective view of an exemplary skateboard including two skateboard trucks in accordance with an alternative embodiment of the invention;

FIG. 12 presents an enlarged, exploded bottom perspective view of the skateboard deck and a truck of FIG. 11;

FIG. 13 presents a bottom front perspective view of a truck of FIG. 11, wherein the storage drawer is shown in an open state;

FIG. 14 presents a rear top perspective of the truck of FIG. 13; and

Figure 15:
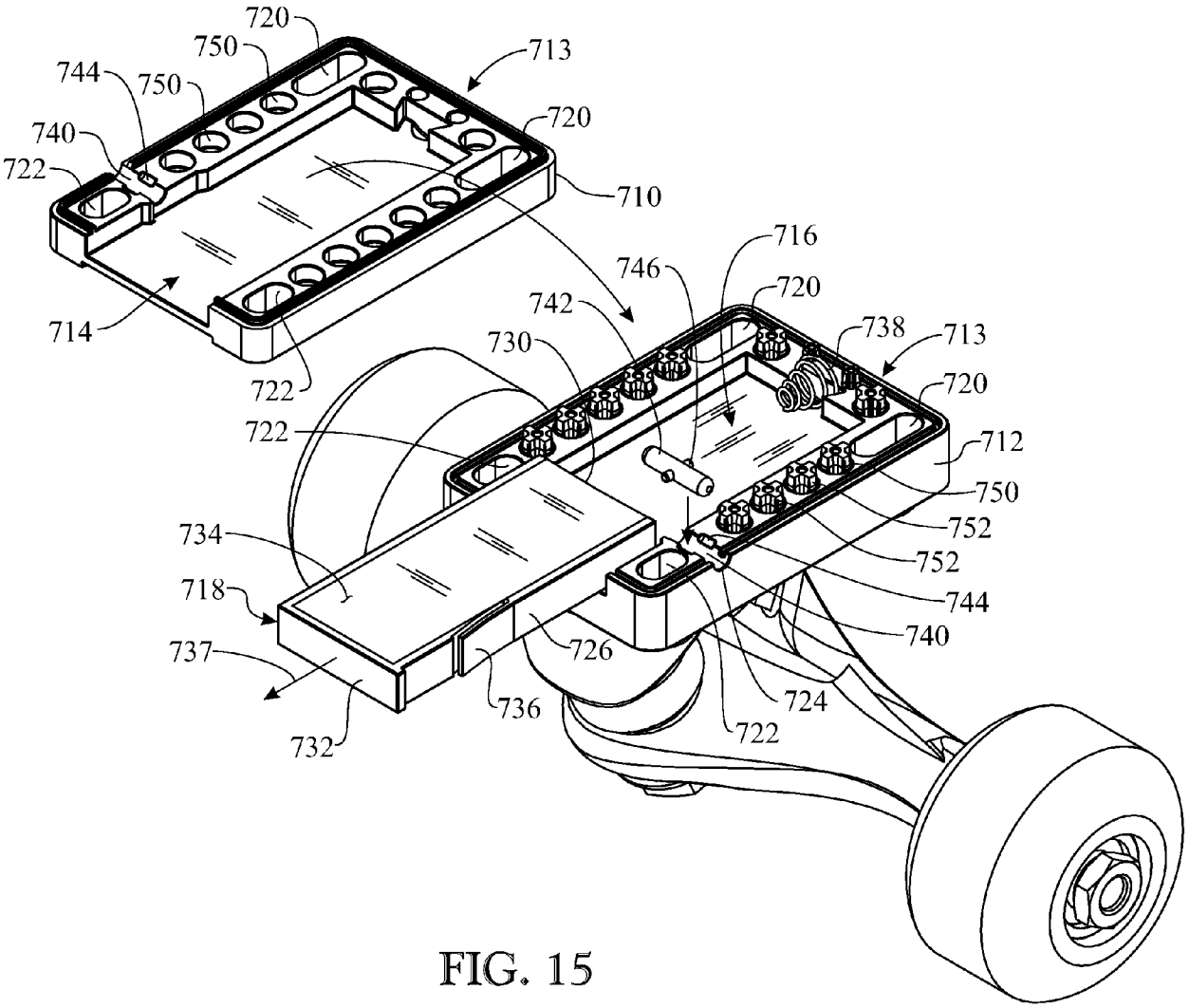

FIG. 15 presents a top front perspective view of the truck of FIG. 13, having removed top member to reveal internal mechanisms of the base plate.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1 and 2 there are shown isometric views of a storage device 100 mountable to the bottom surface of a skateboard, in accordance with a first exemplary embodiment of the present invention. Although the description is referenced to a single storage device 100, it will be understood that a pair of storage devices 100 are typically used on skateboards to accommodate trucks with wheels. The storage device 100 comprises a generally square or rectangular riser body 110 having a planar truck-mounting surface 112 for accommodating a base plate of a truck, and planar mounting surface 113 for attaching the storage device 100 flush to a deck 210 of a skateboard 200, as better illustrated in FIG. 4. In one non-limiting embodiment, the riser body 110 is design having the following dimensions: ¼ inch to 3 inches thick, 3 to 6 inches in length, and 3 to 7 inches in width. The riser body 110 is fabricated from any one or more of the following materials: any reasonable metal, plastic, hard rubber, nylon, composite material, and the like. A variety of alternative dimensions may be implemented to meet the optimum functional requirements of the riser body 110 when mounted to a skateboard 200. Thus, the riser body 110 is constructively designed to prevent "wheel bite" when maneuvering the deck 210 of the skateboard 200 during turns, and to prevent damage to the deck 210 as a result of impact stresses generated on trucks 212, 214, as shown in FIG. 4.

The riser body 110 includes a plurality of mounting holes 114 formed completely through the rise body 110, preferably along each of the longitudinal peripheral edges, for receiving fasteners 120 and mounting the riser body 110 to the bottom surface of the skateboard deck 210. The fasteners 120 may be wood screws, threaded bolts that align with threaded apertures provided within deck 210. In an alternative to the mechanical fastener embodiment, the riser body 110 may be attached to the bottom surface of the skateboard deck 210 using a bonding agent such as adhesive, contact cement, and the like.

A storage cavity 122 is formed within the riser body 110. The storage cavity 122 extends inward from a cavity opening 123. In one non-limiting embodiment, the storage cavity 120 is dimensioned to hold a variety of small items therein including, but not limited to, keys, paper money, matches, a small knife, string, a whistle, shoe laces, a small pen or pencil, chalk, expensive jewelry, coins, or other articles or items. In one exemplary embodiment, a tool such as a small screwdriver 124 is included for storage. A screwdriver 124 may prove helpful in tightening screws that may loosen over time. Those skilled in the art will appreciate that storage cavity 122 can be located anywhere within the riser body 110 and be sized having any suitable shape and dimensions. Further, the storage cavity 122 may be designed in a custom configuration to accommodate a particular item therein. Although the riser body 110 is shown as a single unit in the present embodiment, the riser body 110 may comprise separate and distinct members that are assembled together to form the storage cavity 122.

With continued reference to FIGS. 1 and 2, an integral portion of the riser body 110 is tailored to provide a removable closure 116 for sealing the storage cavity 122. The exemplary removable closure 116 includes a first cavity sealing edge 126 integrally joined to a second cavity sealing edge 128. The edges 126, 128 correspondingly engage with a mating first cavity opening edge and a second cavity opening edge formed along the peripheral edges of storage cavity 122 to provide flush engagement between the removable closure 116 and the riser body 110 when the removable closure 116 is attached to the riser body 110. The removable closure 116 includes a closure attachment aperture 118 for receiving a fastener 120 to fasten the closure 116 in place. In one alternative embodiment, the removable closure 116 may include a cutout that correspondingly aligns with a fastening section (not shown) integrally formed with riser body 110 where the fastening section includes a threaded aperture for receiving the threaded end of a fastener 120. Thus, in construction, when the removable closure 116 is attached to the riser body 110, the threaded aperture of the fastening section would align with the closure hole 118 of the removable closure 116 to permit the fastener 120 to extend through the closure hole 118 and threadably engage the threaded aperture of the fastening section thus providing an alternative method of securing the closure 116 to the riser body 110. It will be understood that the removable closure 116 may be attached to the riser body 110, or alternatively, to the bottom of the deck 210 using any suitable fastener that may include a nut and bolt, screws, magnets, spring detents, snaps, hook and loop, clips, clamps, or any other suitable fastener used for removably attaching two pieces together.

Turning now to FIG. 3, there is shown a cross-sectional view of the riser body 110 with closure 116 separated therefrom to expose the storage cavity 122. The exemplary storage cavity 122 extends longitudinally within riser body 110 terminating at a distal surface 132, and having a cavity opening 123. In the exemplary embodiment, a small item such as a screwdriver 124 is readily positioned for storage within storage cavity 122. A biasing member 134, shown as a coiled compression spring in the exemplary embodiment, is secured to the distal surface 132 of the storage cavity 122. The biasing member 134 rests against or is attached to the distal surface 132 in a relaxed, unbiased state, generally denoted as 136. The biasing member 134 is employed to help eject one or more items from the storage cavity 122 so that the items do not remain lodged within the storage cavity 122. For example, the small screwdriver 124 is inserted within the storage cavity 122 so that when the closure 116 is attached to the riser body 110, one end of the tool 124 moves downwards to compress biasing member 134. Upon removal of the closure 116, the biasing member 134 propels the screwdriver 124 out from the storage cavity 122, allowing the user to easily grasp one end of the screwdriver 124 by hand.

A first and/or second storage device 100 is mounted on the bottom surface of deck 210 along the leading and/or trailing end of skateboard 400, respectively, as illustrated in FIG. 4. A base plate of each truck 212, 214 is correspondingly affixed to the truck-mounting surface 112 of each storage device 100 using fasteners 120 that are inserted through the mounting holes 114. Each truck 212, 214 includes an axle that is attached to the base plate and designed to pivot about a horizontal axis, thus causing angular rotation of the axle about a vertical axis, which results in a change in direction of the skateboard 200 during use. Two wheels 216 are mounted to the axle of each truck 212, 214, via, bearings (not shown), wherein each wheel 216 is mounted to each respective end of the truck axle. The wheels 216 are fabricated from polyurethane and are designed to withstand repeated use and impact forces when maneuvering the skateboard 200 on hard surfaces. The polyurethane can be tailored to suit the desired application by varying the hardness of the polyurethane.

Turning now to FIGS. 5 and 6, there are shown isometric views of a storage device 300, in accordance with an alternative embodiment of the present invention. The storage device 300 comprises a top and bottom member 310, 312 each including a peripheral wall that extends along the outer edge of a panel to define two sidewalls, an end wall, and a front wall having a cutout forming an opening. The top member 310 is attached to the bottom member 312 forming a generally square or rectangular riser body 314 having a closed end 313, rounded corners, and top and bottom panels that define a storage cavity 316 for removably receiving a storage drawer 318. The top and bottom members 310, 312 may be constructed from a durable plastic, metal hard rubber material, and the like, and are assembled together using fasteners such as screws, bolts, a bonding agent, frictional engagement, a mechanical interlock, and the like. The top surface and/or bottom surface can be open, similar to a frame, or solid, or referred to as a panel. In an open configuration the top surface of the compartment is enclosed by the skateboard surface of the skateboard deck 510 (FIG. 10) and the bottom surface of the compartment is enclosed by the skateboard trucks 512, 514 (FIG. 10).

A plurality of mounting holes 320, 322 are formed vertically through the peripheral wall of each member 310, 312, preferably about the four corners, for securely attaching the storage device 300 to the bottom surface of the deck 510 of skateboard 500, via mounting fasteners. In the preferred embodiment, two or more mounting holes 320, 322 comprise an oval shape for allowing longitudinal positioning of the storage device 300 when attaching the storage device 300 to the bottom surface of the deck 510 (FIG. 10).

Semi-circular grooves are formed in both the top and bottom member 310, 312 and join together to form a release latch access aperture 324 that extends perpendicular through the riser body 324 within the storage cavity 316. Release latch access aperture 324 is positioned to align with a resilient latch 336 that is provided on a storage drawer 318 when the storage drawer 318 is fully inserted within the storage cavity 316.

The storage cavity 316 is dimensioned to slidably receive the storage drawer 318. In construction, the storage drawer 318 includes two vertical sidewalls 326, 328, a vertical back wall 330, and a vertical front wall 332 integrally joined to a perpendicularly arranged bottom 334 to define an object containment volume for receiving and storing a variety of small items. A resilient latch 336 is provided along the coaxial plane of one sidewall 326 with a proximal end forming an integral part of sidewall 326, and a distal end flaring slightly outwards. The resilient characteristics of the resilient latch 326 permit the resilient latch 336 to flex inwards when a force is applied to the external surface thereof. A drawer latch retention feature 348 (FIGS. 7, 8) and respective recess is provided along an inner perimeter of the storage cavity 316, of riser body 314, to engage with the resilient latch 336 and retain the storage drawer 318 within the riser body 314, as better illustrated in FIG. 9.

With reference to FIGS. 7 and 8, the top member 310, of the riser body 314, has been removed to expose an internal area of the bottom member 312 to more clearly present the storage cavity 316, a pin groove 340, the biasing member 338, and the like. The storage drawer 318 is dimensioned to slide in and out of the storage cavity 316 with ease, along a longitudinal direction generally denoted by arrow 337. The biasing member 338 is assembled to an internal surface of the cavity end wall, of the bottom member 312 (or alternatively the top member 310) to readily engage with the back wall 330 of the storage drawer 318 when the storage drawer 318 is fully inserted within the riser body 314. In the preferred embodiment, the biasing member 338 utilizes a compression spring, however, the biasing member 338 may comprise any resilient member integrally formed with the internal surface of the end wall of bottom member 312. The biasing member 338 is designed to propel the storage drawer 318 outward from the storage cavity 316 of the riser body 314. The storage device 300 can include a plurality of recessions formed through within the sidewalls of at least one of the top and bottom members 310, 312. A mating boss can be integrated into the mating member. The recessions additionally remove weight from the storage device 300.

The pin groove 340 is formed in the bottom member 312 to readily accommodate a release pin 342, as shown in FIG. 8. A similar portion of the pin groove 340 is formed in the top member 310. Indentations 344 are formed along opposite edges of pin groove 340 to slidably receive stub ends of a crossbar 346 that is provided through a latch release pin 342. Each indentation 344 comprises an elongated slot designed to receive and permit the stubs of the crossbar 346 to slide freely within the indentations 344 permitting the latch release pin 342 to move laterally within the riser body 314, or parallel to and within the release latch access aperture 324 while being retained within the release latch access aperture 324.

Turning to FIG. 9, there is shown a top view of the storage device 300 with the top member 310 removed showing the storage drawer 318 fully inserted within the storage cavity 316, which is partially defined by the bottom member 312, in accordance with the alternative embodiment of the present invention. The exemplary illustration presents a variety of small jewelry items, such as a ring 400, and a pendant 410 being placed within the storage drawer 318 for storage. The storage drawer 318 is fully inserted within the storage cavity 316 such that the resilient latch 336, located on the side of the drawer 318, butts against drawer latch retention feature 348 formed in the bottom member 312 (and/or top member 310) to prevent the storage drawer 318 from sliding outwards from the storage cavity 316 until desired. The resilient latch 336 naturally flares outwards pushing against the distal end of the release pin 342 forcing the stubs of crossbar 346 to slide outwards against respective ends of the indentations 344. With the storage drawer 318 fully inserted within the storage cavity 316 of the riser body 314, the back wall 330 of the drawer 318 compresses firmly against the biasing member 338. With the storage drawer 318 seated fully within the storage cavity 316, the front wall 332, of the storage drawer 318, preferably aligns flush with the front, outer surface of both the top and bottom members, 310, 312, of the riser body 314, as better illustrated in FIG. 5.

In use, to gain access to items 120, 122 stored within the storage drawer 318, a user simply pushes the latch release pin 342 in the general direction denoted by the arrow allowing the stubs of the crossbar 346 to slide within the indentations 344. The distal end of the latch release pin 342 engages with the resilient latch 336 forcing the resilient latch 336 to flex inwards thus dislodging the resilient latch 336 from the drawer latch retention feature 348. The potential energy provided by the compressed biasing member 338 is immediately converted to kinetic energy, propelling the storage drawer 318 outwards from the storage cavity 316 of the riser body 314 thereby granting access to the stored objects, such as the ring 400 and pendant 410.

As better illustrated in FIG. 10, a first and/or second storage device 300 is mounted on the bottom surface of the skateboard deck 510 along a leading and/or trailing end of skateboard 500, respectively. A base plate of each skateboard truck 512, 514 is correspondingly affixed to the planar surface of each storage device 300, using fasteners inserted through mounting holes 320, 322. Each skateboard truck 512, 514 includes an axle that is attached to the base plate and designed to rotate freely along a vertical axis. Two wheels 516 are mounted to the axle of each truck 512, 514, via, bearings (not shown), wherein each wheel 516 is mounted to each respective end of the truck axle. The wheels 516 are fabricated from polyurethane and are designed to withstand repeated use and impact forces when maneuvering the skateboard 500 on hard surfaces. The polyurethane can be tailored to suit the desired application by varying the hardness of the polyurethane.

Storage devices 100, 300 provide a convenient and discrete method for storing small items, such as tools 124, expensive jewelry 400, 410, on a skateboard 200, 500 without the need of having to carry such items 124, 400, 410 on the person, or in a separate pouch or bag. Skateboard riders can discretely store a variety of small items 124, 400, 410 within the storage cavity 122 of the storage device 100, or within the storage drawer 318 of the storage device 300. The biasing member 134 is employed to prevent the small items 120 from remaining lodged within the storage device 100, and to propel the storage drawer 318 outwards from storage device 300. Skateboard riders can fully enjoy riding the skateboard 200, 500 knowing the items 124, 400, 410 are stored safely and discretely in a storage device 100, 300 that comprises a standard accessory used on skateboards 200, 500.

The storage devices 100, 300 may be integrated with the respective trucks 212, 216, 512, 516 as a single, one-piece unit to provide quick and easy installment.

For instance, turning now to FIGS. 11 and 12, there is shown a bottom, front isometric view of an exemplary skateboard 600 including a skateboard deck 610, two pairs of wheels 620 and a pair of skateboard trucks 700, one or both of which can be provided with an inner storage cavity as will be explained. The skateboard trucks 700 carry a respective pair of wheels 620 at a certain distance from the skateboard deck 610. Each skateboard truck 700 includes a base plate 702, and a hanger or axle 760 affixed to the base plate 702 with a bolt or kingpin 762 and nut 764. The base plate 702 is attached to a bottom planar surface of the deck 610 by fasteners 770, which generally pass through the base plate 702 and thread into pre-drilled mounting holes 614 in the deck 610, best shown in FIG. 12. The base plate 702 further comprises an elevated portion 780 into which the kingpin 762 is inserted and secured. The truck 700 further includes one or more bushings 782 (two bushings 782, in the present embodiment), to permit the axle 760 to rotate freely about a central axis of the kingpin 762 when riding the skateboard, and a pivot bushing 784 housed within a pivot cup 786 for allowing the axle 760 to sway or pivot sideways with respect to the base plate 702 and thus to the skateboard deck 610. One of ordinary skill in the art will understand that several types of skateboard truck designs, and particularly of axles, bushings, kingpins, base plates and elevated portions of the base plate may be employed construct the present invention; these various designs will not be described in detail so as not to obscure the invention.

Turning now to FIGS. 13 through 14, the base plate 702 comprises a top and bottom member 710, 712 each including a peripheral wall that extends along the outer edge of a panel to define two sidewalls, an end wall, and a front wall having a cutout forming an opening 714 in longitudinal opposition to a closed end 713. The top member 710 is attached to the bottom member 712 forming a generally square or rectangular body having rounded corners, and defining an inner cavity 716 for removably receiving a storage drawer 718. The top and bottom members 710, 712 may be constructed for instance from steel, aluminum, titanium, magnesium or the like, and can be assembled together using fasteners such as, without limitation, screws, bolts, a bonding agent, frictional engagement, a mechanical interlock, a combination thereof, and the like.

A plurality of mounting holes 720, 722 are formed vertically through the peripheral wall of each of the top and bottom members 710, 712, preferably about the four corners, for securely attaching the base plate 702 to the bottom surface of the deck 610 of skateboard 600, via the aforementioned mounting fasteners 770. In certain embodiments, all mounting holes 720, 722 are round. In other embodiments, two or more mounting holes 720, 722 comprise an oval shape for allowing longitudinal positioning of the base plate 702 when attaching the base plate 702 to the bottom surface of the deck 610.

Semi-circular grooves are formed in both the top and bottom member 710, 712 and join together to form a release latch access aperture 724 (FIG. 13) that extends perpendicular through the base plate 702 within the inner cavity 716. Release latch access aperture 724 is positioned to align with a resilient latch 736 of the storage drawer 718 when the storage drawer 718 is fully inserted within the inner cavity 716.

The inner cavity 716 is dimensioned to slidably receive the storage drawer 718. In construction, the storage drawer 718 includes two vertical sidewalls 726, 728, a vertical back wall 730, and a vertical front wall 732 integrally joined to a perpendicularly arranged bottom 734 to define an object containment space 735 (FIG. 13) for receiving and storing a variety of small items. The resilient latch 736 is provided along the coaxial plane of one sidewall 726 with a proximal end forming an integral part of sidewall 726, and a distal end flaring slightly outwards. The resilient characteristics of the resilient latch 736 permit the resilient latch 736 to flex inwards when a force is applied to the external surface thereof. A drawer latch retention feature 748 (FIG. 15) and respective recess is provided along an inner perimeter of the inner cavity 716 of the base plate 702, to engage with the resilient latch 736 and retain the storage drawer 718 within the base plate 702, in the same way as the drawer latch retention feature 348 and resilient latch 336 of FIG. 9.

With reference to FIG. 15, the top member 710 of the base plate 702 has been disengaged to expose an internal area of the bottom member 712 to more clearly present the inner cavity 716, a pin groove 740, a biasing member 738, and the like. The storage drawer 718 is dimensioned to slide in and out of the inner cavity 716 with ease, along a longitudinal direction generally denoted by arrow 737. The biasing member 738 is assembled to an internal surface of the cavity end wall, of the bottom member 712 (or alternatively the top member 710) to readily engage with the back wall 730 of the storage drawer 718 when the storage drawer 718 is fully inserted within the base plate 702. In certain embodiments, the biasing member 738 comprises a compression spring, as shown; however, in the biasing member 738 may comprise other resilient structures, such as but not limited to any resilient member integrally formed with the internal surface of the end wall of bottom member 712. The biasing member 738 is biased to propel the storage drawer 718 outward from the inner cavity 716 of base plate 702. The base plate 702 can include a plurality of recessions 750 formed through within the sidewalls of at least one of the top and bottom members 710, 712. A mating boss 752 can be integrated into each recession 750 to facilitate assembly of the top and bottom members 710, 712. The recessions 750 additionally remove weight from the base plate 702.

The pin groove 740 is formed in the top and bottom members 710, 712 to readily accommodate a release pin 742, as shown in FIG. 15. Indentations 744 are formed along opposite edges of pin groove 740 to slidably receive stub ends of a crossbar 746 that is provided through the latch release pin 742. Each indentation 744 comprises an elongated slot designed to receive and permit the stubs of the crossbar 746 to slide freely within the indentations 744 permitting the latch release pin 742 to move laterally within the base plate 702, or parallel to and within the release latch access aperture 724 while being retained within the release latch access aperture 724.

Similarly to the embodiment of FIG. 9, the storage drawer 718 can be fully inserted within the inner cavity 716 such that the resilient latch 736 on the side of the storage drawer 718 butts against drawer latch retention feature 748 formed in the bottom member 712 (and/or top member 710) to prevent the storage drawer 718 from sliding outwards from the inner cavity 716 until desired. The resilient latch 736 naturally flares outwards pushing against the distal end of the release pin 742 forcing the stubs of crossbar 746 to slide outwards against respective ends of the indentations 744. With the storage drawer 718 fully inserted within the inner cavity 716 of the base plate 702, the back wall 730 of the storage drawer 718 compresses firmly against the biasing member 738. With the storage drawer 718 seated fully within the inner cavity 716, the front wall 732 of the storage drawer 718 preferably aligns flush with the front, outer surface of both the top and bottom members 710, 712 of the base plate 702, as better illustrated in FIG. 11.

In use, to gain access to the object containment space 735 within the storage drawer 718, a user simply pushes the latch release pin 742 in an inward direction allowing the stubs of the crossbar 746 to slide within the indentations 744. The distal end of the latch release pin 742 engages with the resilient latch 736 forcing the resilient latch 736 to flex inwards thus dislodging the resilient latch 736 from the drawer latch retention feature 748. The potential energy provided by the compressed biasing member 738 is immediately converted to kinetic energy, propelling the storage drawer 718 outwards from the inner cavity 716 of the base plate 702 thereby reaching the situation of FIG. 13 and granting access to the object containment space 735.

Thus, the object containment space 735 of the present solution is integrated in the skateboard truck 700 and does not require a riser or other accessory to carry personal items, thus providing quick and easy installment. In addition, the storage drawer 718 and object containment space 735 (FIG. 13) for receiving and storing a variety of small items are arranged in such a way that, when the truck 700 is in an upright position as shown in FIGS. 11 and 15, the object containment space 735 is facing downward and topped by the bottom 734 of the storage drawer 718, whereas if the truck 700 is in an inverted position, corresponding to that of placing the skateboard 600 upside down, the object containment space 735 is facing upward and away from the deck 610, with the bottom 734 of the storage drawer 718 arranged below the object containment space 735. Having the object containment space 735 face upward and away from the deck 610 in the inverted position of the truck 700 permits the user to easily and quickly access the drawer contents by flipping the skateboard 600 over to an inverted position and opening the storage drawer 718.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A skateboard truck, comprising a base plate, an elevated portion extending from said base plate, and an axle attached to said elevated portion, wherein said base plate comprises:

a cavity opening passing through a segment of an outer wall of said base plate;

an inner cavity extending inward from the cavity opening and bound by a cavity defining surface;

a plurality of mounting holes formed through said base plate, wherein each mounting hole is located proximate an outer edge of said base plate and at a periphery of said inner cavity, wherein a pattern of said mounting holes is arranged to align with mounting apertures of a skateboard deck;

a storage drawer including a drawer bottom integrally joined to drawer sidewalls, a drawer end wall, and a drawer front wall defining an item storage compartment volume for retaining a variety of items therein, wherein said item storage compartment volume is oriented toward said axle, and wherein said storage drawer is removably insertable through said cavity opening and into said inner cavity, to conceal said item storage compartment volume;

a biasing member positioned within said inner cavity at a location generally opposing said cavity opening, to readily engage with said drawer end wall when said storage drawer is inserted within said inner cavity.

2. The storage device of claim 1, further including:

a release latch access aperture formed perpendicular through said base plate and extending within said inner cavity;

a drawer latch retention feature integrated into a portion of the cavity defining surface at a location proximate said release latch access aperture;

a resilient latch including one end integrally formed with one of said drawer sidewalls and a flexible end tapering outwards away from said one of said drawer sidewalls; and a release pin retained within said release latch access aperture, said release pin having a distal end engaging with said flexible end of said resilient latch;

wherein said storage drawer is removably insertable through said cavity opening and inserted into said inner cavity such that a front edge of said flexible end of said resilient latch releasably engages said drawer latch retention feature, and wherein said release latch access aperture aligns with said flexible end of said resilient latch when said storage drawer is fully inserted within said inner cavity.

3. The storage device of claim 2, wherein said release pin includes a crossbar extending perpendicularly outward from said release pin forming a first stub and a second stub situated opposite said first stub.

4. The storage device of claim 3, wherein said release latch access aperture includes a first indentation receiving said first stub, and a second indentation receiving said second stub, each indentation having a predetermined length adapted to permit said release pin to slide back and forth within said release latch access aperture without falling out of said release latch access aperture.

5. The storage device of claim 4, wherein said release pin is slidably movable inward, against an outward biasing force provided by said flexible end of said resilient latch, to dislodge said front edge of said flexible end of said resilient latch from said drawer latch retention feature freeing said storage drawer.

6. The storage device of claim 5, wherein said biasing member is configured to propel said storage drawer outwards from said inner cavity when the storage drawer is freed, to expose items stored in said storage drawer.

7. The storage device of claim 1, wherein said biasing member comprises a spring that is compressed when said storage drawer in fully inserted within said inner cavity.

8. A skateboard truck, comprising a base plate, an elevated portion extending from said base plate, and an axle attached to said elevated portion, wherein said base plate is defined by a top member and a bottom member attached to one another, wherein said base plate comprises:

a cavity opening passing through a segment of an outer wall of said base plate;

an inner cavity extending inward from the cavity opening and bound by a cavity defining surface;

a plurality of mounting holes formed through said base plate, wherein each mounting hole is located proximate an outer edge of said base plate, wherein a pattern of said mounting holes is arranged to align with mounting apertures of a skateboard deck;

a release latch access aperture formed perpendicular through said base plate and extending within said inner cavity;

a drawer latch retention feature integrated into a portion of the cavity defining surface at a location proximate said release latch access aperture;

a storage drawer including a drawer bottom integrally joined to drawer sidewalls, a drawer end wall, and a drawer front wall defining an item storage compartment volume for retaining a variety of items therein, wherein said item storage compartment volume is oriented toward said axle;

a resilient latch including one end integrally formed with one of said drawer sidewalls and a flexible end tapering outwards away from said one of said drawer sidewalls; and wherein said storage drawer is removably insertable through said cavity opening and inserted into said inner cavity such that a front edge of said flexible end of said resilient latch releasably engages said drawer latch retention feature, and wherein said release latch access aperture aligns with said flexible end of said resilient latch when said storage drawer is fully inserted within said inner cavity.

9. The storage device of claim 8, further including a release pin retained within said release latch access aperture, said release pin having a distal end engaging with said flexible end of said resilient latch.

10. The storage device of claim 9, wherein said release pin includes a crossbar extending perpendicularly outward from said release pin forming a first stub and a second stub situated opposite said first stub.

11. The storage device of claim 10, wherein said release latch access aperture includes a first indentation receiving said first stub, and a second indentation receiving said second stub, each indentation having a predetermined length adapted to permit said release pin to slide back and forth within said release latch access aperture without falling out of said release latch access aperture.

12. The storage device of claim 11, wherein said release pin is slidably movable inward, against an outward biasing force provided by said flexible end of said resilient latch, to dislodge said front edge of said flexible end of said resilient latch from said drawer latch retention feature freeing said storage drawer.

13. The storage device of claim 12, further comprising a biasing member positioned within said inner cavity at a location generally opposing said cavity opening, to readily engage with said drawer end wall when said storage drawer is inserted within said inner cavity, wherein said biasing member is configured to propel said storage drawer outwards from said inner cavity when the storage drawer is freed, to expose items stored in said storage drawer.

14. The storage device of claim 8, further including a biasing member positioned within said inner cavity at a location generally opposing said cavity opening, to readily engage with said drawer end wall when said storage drawer is inserted within said inner cavity.

15. The storage device of claim 14, wherein said biasing member comprises a spring that is compressed when said storage drawer in fully inserted within said inner cavity.

16. A skateboard truck, comprising a base plate configured to be attached to a skateboard deck, wherein said base plate includes:

a deck-facing surface configured to be arranged towards a skateboard deck, a cavity opening passing through an outer sidewall of said base plate;

an inner cavity extending inward from the cavity opening and bound by a cavity defining surface;

a release latch access aperture formed perpendicular through said base plate and extending within said inner cavity;

a drawer latch retention feature integrated into a portion of the cavity defining surface at a location proximate said release latch access aperture;

a storage drawer including a drawer bottom integrally joined to drawer sidewalls, a drawer end wall, and a drawer front wall defining an item storage compartment volume for retaining a variety of items therein, wherein said item storage compartment volume is configured to be oriented away from said deck-facing surface;

a resilient latch including one end integrally formed with one of said drawer sidewalls and a flexible end tapering outwards away from said one of said drawer sidewalls; and wherein said storage drawer is removably insertable through said cavity opening and into said inner cavity such that a front edge of said flexible end of said resilient latch releasably engages said drawer latch retention feature, and wherein said release latch access aperture aligns with said flexible end of said resilient latch when said storage drawer is fully inserted within said inner cavity.

17. The storage device of claim 16, further including a biasing member positioned within said inner cavity at a location generally opposing said cavity opening, to readily engage with said drawer end wall when said storage drawer is inserted within said inner cavity.

18. The storage device of claim 17, further comprising a release element, wherein said release element is inserted through said release latch access aperture in a manner to contact said flexible end of said resilient latch, wherein when an insertion force is applied to said release element, said release element compresses resilient latch freeing said front edge of said flexible end of said resilient latch from said drawer latch retention feature from said storage drawer, causing said biasing member to propel said storage drawer outward from said inner cavity to expose items placed in said storage drawer.

19. The storage device of claim 17, wherein said biasing member comprises a spring that is compressed when said storage drawer in fully inserted within said inner cavity.

* * * * *